US012310468B2

(12) United States Patent
Yan

(10) Patent No.: US 12,310,468 B2
(45) Date of Patent: May 27, 2025

(54) SIDE-ARM UMBRELLA STRUCTURE

(71) Applicant: Banggan Yan, Yongkang (CN)

(72) Inventor: Banggan Yan, Yongkang (CN)

( * ) Notice: Subject to any disclaimer, the term of this patent is extended or adjusted under 35 U.S.C. 154(b) by 151 days.

(21) Appl. No.: 18/128,275

(22) Filed: Mar. 30, 2023

(65) Prior Publication Data

US 2024/0324740 A1 Oct. 3, 2024

(51) Int. Cl.

| | |
|---|---|
| ***A45B 25/14*** | (2006.01) |
| ***A45B 23/00*** | (2006.01) |
| ***A45B 25/02*** | (2006.01) |
| ***A45B 25/10*** | (2006.01) |

(52) U.S. Cl.

CPC ..... *A45B 25/14* (2013.01); *A45B 23/00* (2013.01); *A45B 25/02* (2013.01); *A45B 25/10* (2013.01); *A45B 2023/0043* (2013.01)

(58) Field of Classification Search

CPC ... A45B 2019/007; A45B 25/02; A45B 25/14; A45B 25/10

See application file for complete search history.

(56) References Cited

U.S. PATENT DOCUMENTS

| | | | | |
|---|---|---|---|---|
| 5,960,806 | A * | 10/1999 | Steiner | A45B 25/14 135/21 |
| 6,588,438 | B1 * | 7/2003 | Steiner | A45B 25/06 135/21 |
| 8,104,492 | B2 * | 1/2012 | Dan | A45B 25/14 135/21 |
| 9,220,325 | B2 * | 12/2015 | Ma | A45B 23/00 |
| 9,565,907 | B2 * | 2/2017 | Ma | A45B 25/10 |
| 10,925,362 | B1 * | 2/2021 | Luo | A45B 25/08 |
| 11,122,872 | B2 * | 9/2021 | He | A45B 23/00 |
| 11,375,782 | B2 * | 7/2022 | Yang | A45B 23/00 |
| 11,519,193 | B2 * | 12/2022 | Ma | A45B 23/00 |
| 2016/0113364 | A1 * | 4/2016 | Ostrander | A45B 23/00 135/20.1 |
| 2022/0279904 | A1 * | 9/2022 | He | A45B 23/00 |
| 2023/0371663 | A1 * | 11/2023 | Luo | A45B 17/00 |
| 2024/0358129 | A1 * | 10/2024 | Zhu | A45B 25/06 |

FOREIGN PATENT DOCUMENTS

| | | | | |
|---|---|---|---|---|
| WO | WO-2007039900 A2 * | 4/2007 | | A45B 25/14 |

* cited by examiner

*Primary Examiner* — Noah Chandler Hawk
(74) *Attorney, Agent, or Firm* — Jose Cherson Weissbrot

(57) ABSTRACT

The present invention discloses a novel side-arm umbrella structure, which consists of a bracket and an umbrella body connected to one side of the bracket, wherein the umbrella body forms an umbrella-shaped structure by an upper hinge disc, a lower hinge disc, a first diagonal pull rod, a second diagonal pull rod and a plurality of umbrella ribs and umbrella braces; and the novel side-arm umbrella adopts a transmission mechanism in the form of a chain gear to drive the folding and unfolding of the umbrella, so that the structure is compact and stable, the service life is longer, and the assembly is convenient and the maintenance is simple.

9 Claims, 10 Drawing Sheets

SIDE-ARM UMBRELLA STRUCTURE

TECHNICAL FIELD

The present invention relates to the field of umbrellas, in particular to a novel side-arm umbrella structure.

BACKGROUND

Side-arm umbrella is an umbrella whose umbrella body is located at one side of the bracket. When in use, the bracket is close to the wall, and the use area under the umbrella body can be used for placing tables and chairs or for pedestrians to pass through. Side-arm umbrella is favored by many consumers in beaches and other amusement places.

Side-arm umbrellas in the prior art, such as U.S. patent publication No. US20140311537A1, disclose an umbrella having the crown of the canopy coupled to a support structure via a pivot joint that is structured and configured to allow swiveling and/or tilting of the canopy with ease by a user, in more than one plane or with more than one degree of freedom with respect to the support structure. The canopy frame includes a longitudinal central support hub, and the pivot joint is rotatable about a rotation axis, wherein the axis of the canopy support hub makes a fixed or variable non-zero angle with respect to the pivot joint rotation axis. As a result of the angle between the pivot joint rotation axis and the canopy support hub axis. The rotation of the pivot joint causes tilting of the canopy support hub axis, thus tilting the canopy to change its orientation.

With this solution, the folding and unfolding structure of the side-arm umbrella is mainly composed of a hand crank and a pull wire, and the extension and shortening of the pull wire are controlled by the hand crank to further realize the unfolding and storage of the umbrella surface. However, with the passage of use time, the pull wire may loosen or even break, resulting in a short service life of the product. Once the pull wire breaks, it will cause harm to users under the umbrella surface, which has certain security risks and requires regular maintenance. At the same time, due to its soft characteristics, the pull wire needs regular maintenance.

Based on the above problems, it is necessary to provide a side-arm umbrella with stable structure, long service life, no potential safety hazard to users under the umbrella surface, more convenient assembly, simpler maintenance and higher user experience.

SUMMARY

The present invention provides a novel side-arm umbrella structure, which consists of a bracket and an umbrella body connected to one side of the bracket, wherein the umbrella body forms an umbrella-shaped structure by an upper hinge disc, a lower hinge disc, a first diagonal pull rod, a second diagonal pull rod, a plurality of umbrella ribs and umbrella braces.

In one embodiment of the present invention, a lower end of the umbrella brace is hinged on the lower hinge disc, and an upper end of the umbrella brace is hinged at a middle parts of the umbrella rib, the first diagonal pull rod and the second diagonal pull rod: an upper end of the umbrella rib is hinged on the upper hinge disc: an upper end of the second diagonal pull rod is hinged on the upper hinge disc, and a driven gear is fixed on the upper end of the second diagonal pull rod: an upper end of the first diagonal pull rod is hinged on the upper hinge disc, and the upper end of the first diagonal pull rod is provided with a rotatable driving gear: the first diagonal pull rod is internally provided with a driving mechanism to drive the driving gear to rotate, and the upper hinge disc is internally provided with two intermediate gears to realize the transmission between the driving gear and the driven gear: the umbrella body is hinged with the bracket by the first diagonal pull rod.

In one embodiment of the present invention, an upper umbrella post is hinged below the upper hinge disc, and a lower umbrella post is hinged above the lower hinge disc. The upper umbrella post is provided with a central hole, and the lower umbrella post is inserted into the central hole of the upper umbrella post in a matching manner.

At least one embodiment of the present invention relates to a novel side-arm umbrella structure. The driving mechanism includes a hand crank and a power gear driven by the hand crank, and the power gear and the driving gear are in transmission connection by a chain: the chain and the power gear are both built in the first diagonal pull rod.

BRIEF DESCRIPTION OF DRAWINGS

In order to explain the technical solution of this application more clearly, the drawings needed in the implementation will be briefly introduced below. Obviously, the drawings described below are only some implementations of this application. For those skilled in the art, other drawings can be obtained according to these drawings without creative work.

In the figures.

1, Base: 2, Bracket: 3, Slider: 4, Hand crank: 5, Power gear; 6, Chain: 7, First diagonal pull rod: 8, Hinge rod: 9, Umbrella bone: 10, Upper hinge disc: 11, Driving gear: 12, Intermediate gear: 13, Driven gear: 14, The second diagonal pull rod: 15, umbrella brace: 16, Lower hinge disc: 17, Upper umbrella post: 18, Lower the umbrella post.

DESCRIPTION OF EMBODIMENTS

In the following, the technical solution in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

In this specification, for the sake of convenience, words and expressions indicating orientation or positional relationship such as “middle”, “upper”, “lower”, “front”, “rear”, “vertical”, “horizontal”, “top”, “inner” and “outer” are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

Figure 1:
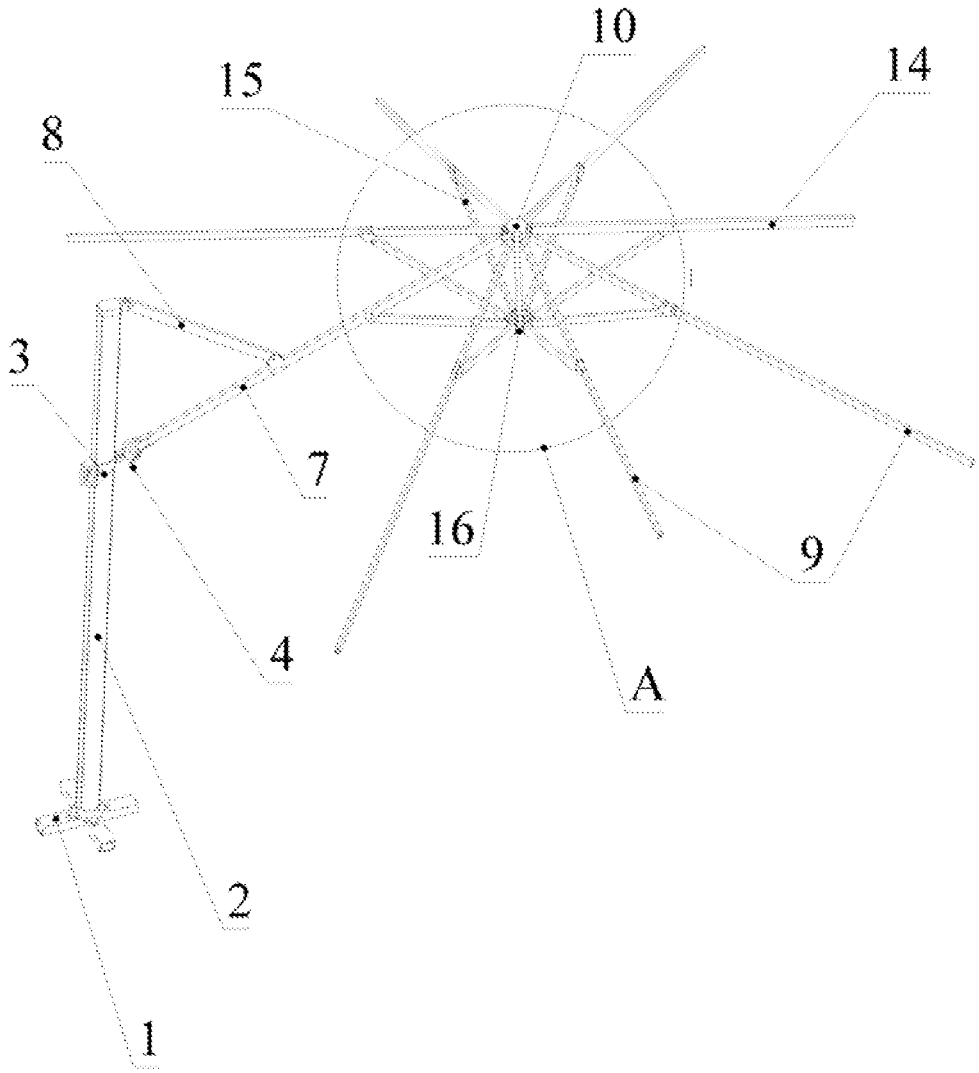
FIG. 1 is a schematic perspective view of a novel side-arm umbrella structure of the present invention.
Figure 2:
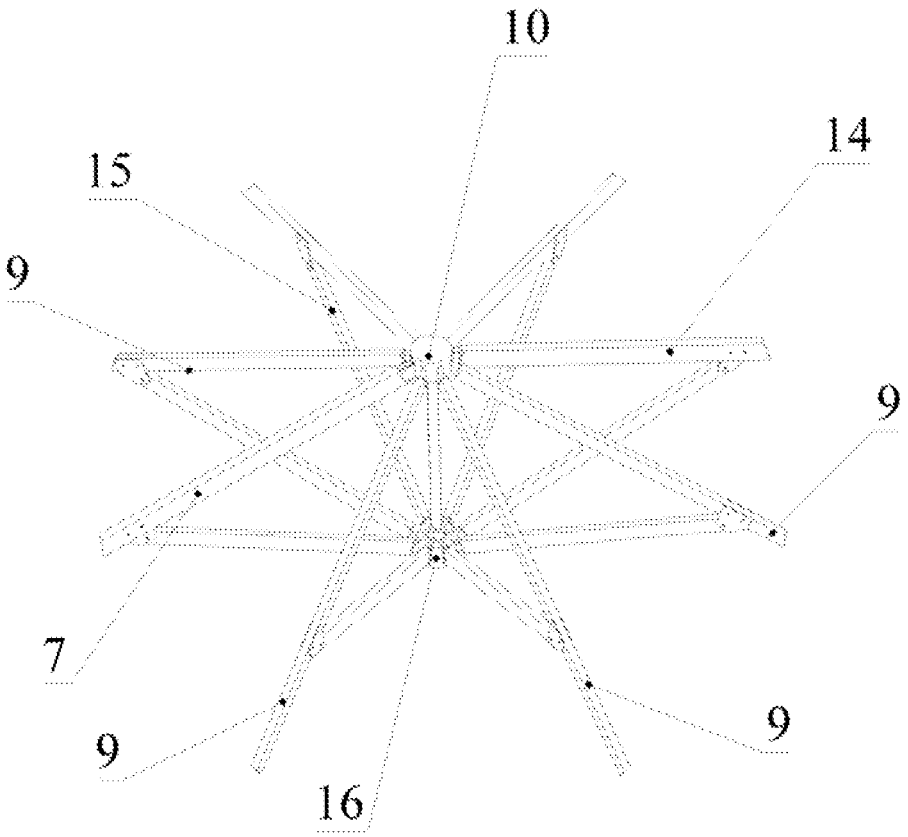
FIG. 2 is an enlarged schematic view at A in FIG. 1.

As shown in FIG. 1 and FIG. 2, a novel side-arm umbrella structure provided by the present invention consists of a bracket 2 and an umbrella body connected to one side of the bracket 2, wherein the umbrella body forms an umbrella-like structure together with an upper hinge disc 10, a lower hinge disc 16, a first diagonal pull rod 7, a second diagonal pull rod 14 and a plurality of umbrella ribs 9 and umbrella braces 15, and the present invention drives a plurality of umbrella ribs 9 and umbrella braces 15 by unfolding and folding the first diagonal pull rod 7 and the second diagonal pull rod 14.

In a preferred embodiment of the present invention, the lower end of the umbrella brace 15 is hinged on the lower hinge disc 16, and the upper end of the umbrella brace 15 is hinged on the middle of the umbrella rib 9, the first diagonal pull rod 7 and the second diagonal pull rod 14, and the upper end of the umbrella rib 9 is hinged on the upper hinge disc 10, and a plurality of umbrella ribs 9 and umbrella braces 15 are evenly distributed along the upper hinge disc 10.

Figure 3:
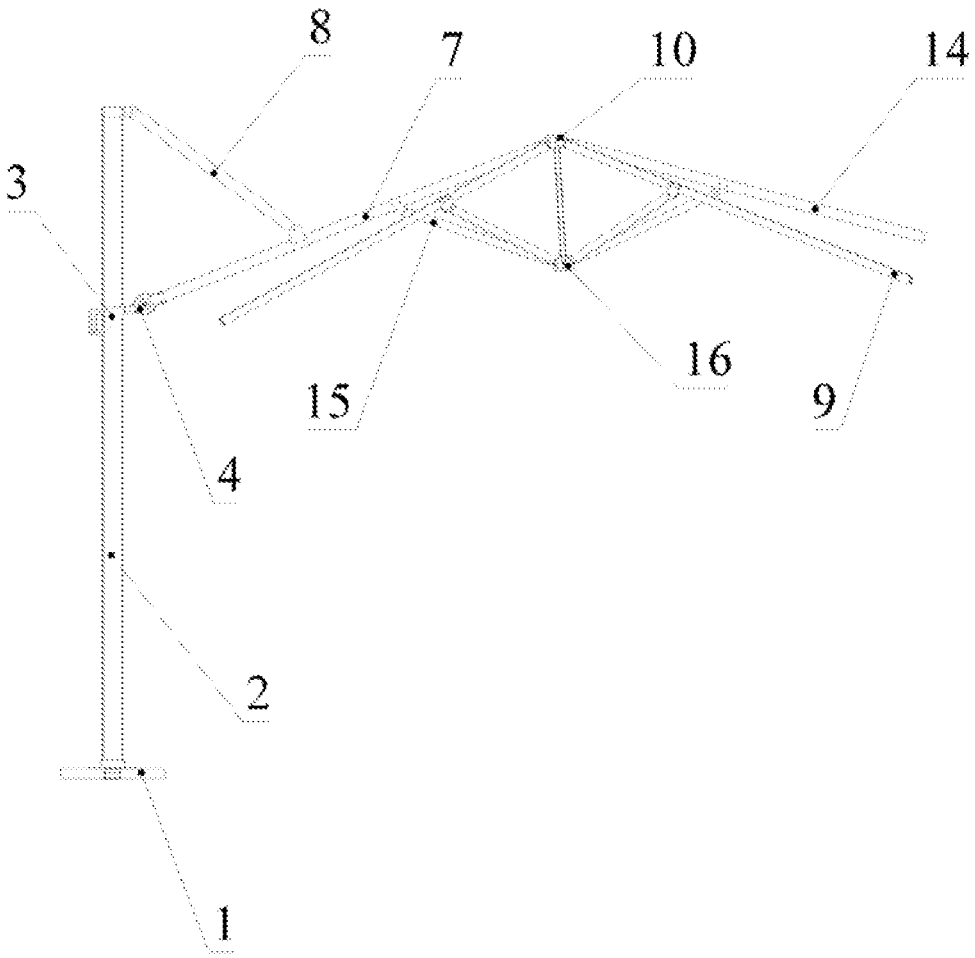
FIG. 3 is a front view of a novel side-arm umbrella structure of the present invention.
Figure 4:
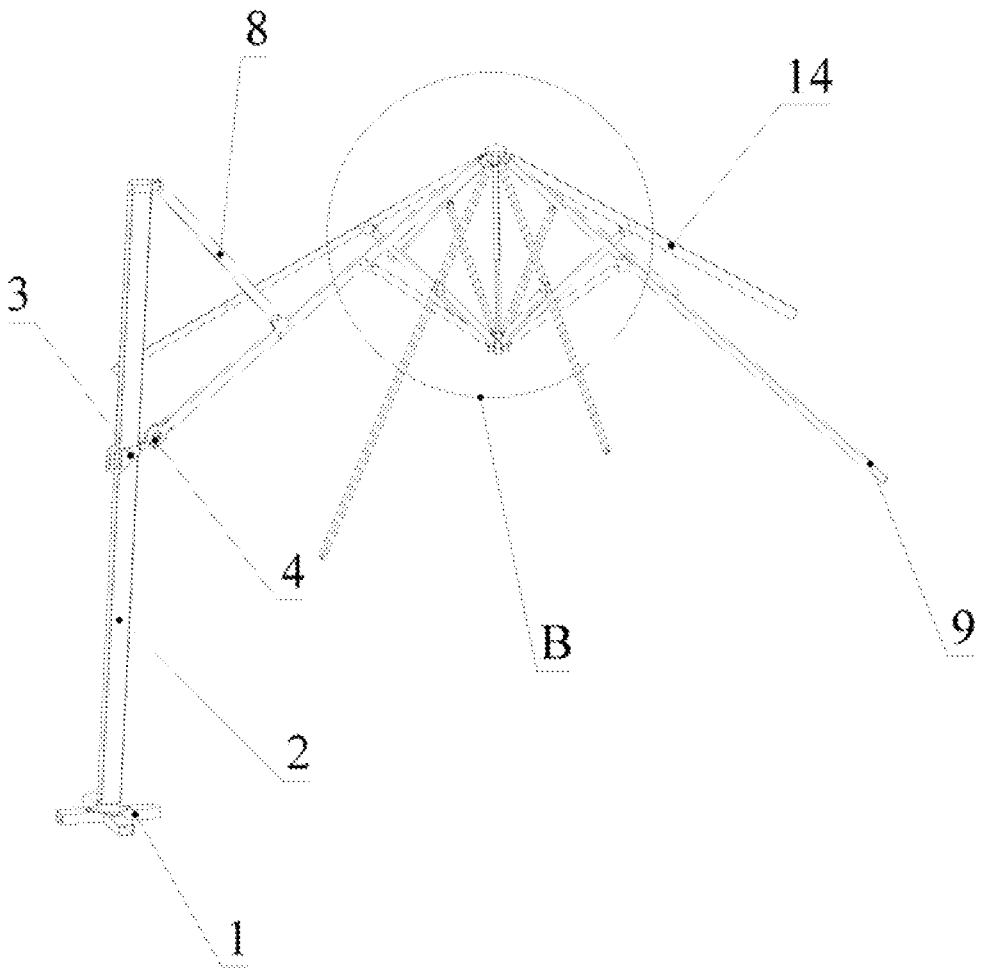
FIG. 4 is a schematic diagram of the storage process of the side-arm umbrella of the present invention.

In order to make the extension and storage of the side-arm umbrella more stable, as shown in FIGS. 3 and 4, a driven gear 13 is fixed at the upper end of the second diagonal pull rod 14, a rotatable driving gear 11 is arranged at the upper end of the first diagonal pull rod 7, a driving mechanism is arranged in the first diagonal pull rod 7 to drive the driving gear 11 to rotate, and an intermediate gear 12 is also arranged in the upper hinge disc 10 to realize the transmission between the driving gear 11 and the driven gear 13.

In this embodiment, the driving gear 11 at the upper end of the first diagonal pull rod 7 is driven, and then the driven gear 13 is driven to rotate by two intermediate gears 12, so as to drive the free end of the second diagonal pull rod 14 to approach the first diagonal pull rod 7. In some embodiments, the number of intermediate gears 12 can be configured according to actual needs, which can be one or more, or the driving gear 11 can be directly engaged with the driven gear 13 without the intermediate gears 12.

Figure 6:
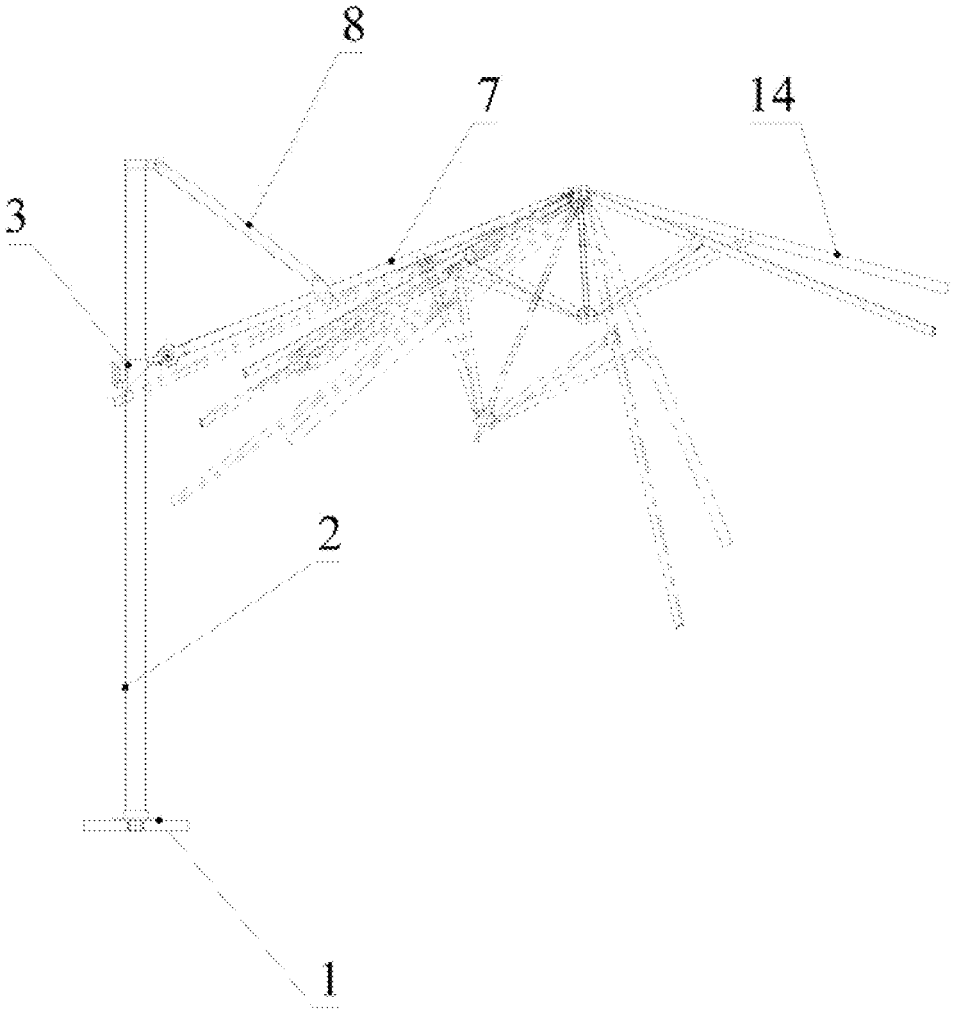
FIG. 6 is a schematic diagram of the storage process of a novel side-arm umbrella structure of the present invention.
Figure 10:
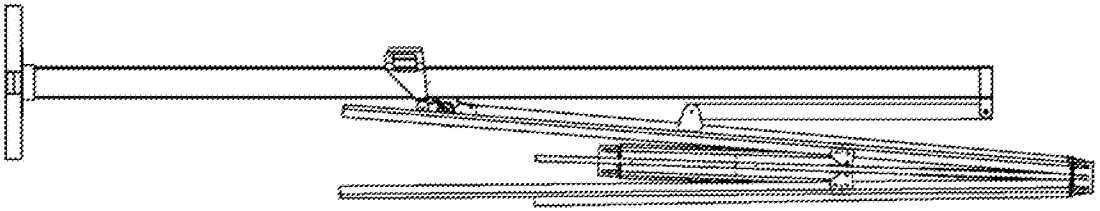
FIG. 10 is a schematic view of the storage of a novel side-arm umbrella structure of the present invention.

As shown in FIG. 6 and FIG. 10, when the free end of the second diagonal pull rod 14 approaches the first diagonal pull rod 7, the upper end of the umbrella brace 15 will rotate around its hinge with the second diagonal pull rod 14. During the rotation, the lower end of the umbrella brace 15 will be displaced longitudinally, which will drive the lower hinge disc 16 at the lower end of the umbrella brace 15 to be displaced longitudinally. In the process of displacement of the lower hinge disc 16, the lower hinge disc 16 will also drive other umbrellas hinged with it to move together, and finally drive other umbrella ribs to approach the first diagonal pull rod 7 together.

As a preferred embodiment of the present invention, in order to make the side-arm umbrella more compact after storage and reduce the failure rate of the side-arm umbrella during deployment and storage, the lower hinge disc 16 is configured to move downward during the storage of the side-arm umbrella.

Figure 5:
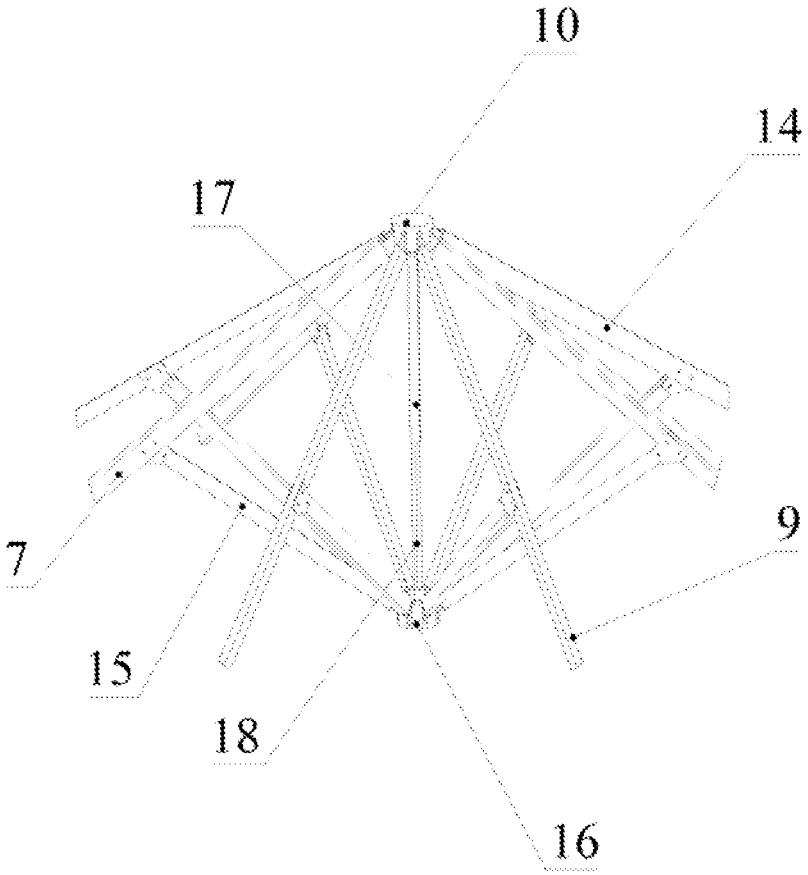
FIG. 5 is an enlarged view at B in FIG. 4.

Specifically, as shown in FIGS. 4 and 5, an upper umbrella post 17 is hinged below the upper hinge disc 10, and a lower umbrella post 18 is hinged above the lower hinge disc 16. The upper umbrella post 17 is provided with a central hole (not shown in the figure), and the lower umbrella post 18 is inserted into the central hole of the upper umbrella post 17 in a matching manner.

In this embodiment, due to the installation of the umbrella post assembly, the lower hinge disc 16 will be blocked by the umbrella post assembly when it moves upward, so that the lower hinge disc 16 can only move downward, and the downward displacement of the lower hinge disc 16 can make the folding and unfolding force of the umbrella body more uniform, and the storage is more compact and space-saving. At the same time, the length of the umbrella brace 15 and the hinge position between the umbrella brace 15, the first diagonal pull rod 7, the second diagonal pull rod 14 and the umbrella rib 9 have more choices, and the side-arm umbrella has more configurations to meet the use needs of different users.

In some embodiments, elastic components (not shown in the figure) can also be arranged in the upper umbrella post 17 and the lower umbrella post 18, and the storage of the side-arm umbrella can be assisted by the elasticity of the elastic components.

In order to facilitate users to use the side-arm umbrella, the present invention provides a driving mechanism to drive the main gear 11 to rotate.

Figure 7:
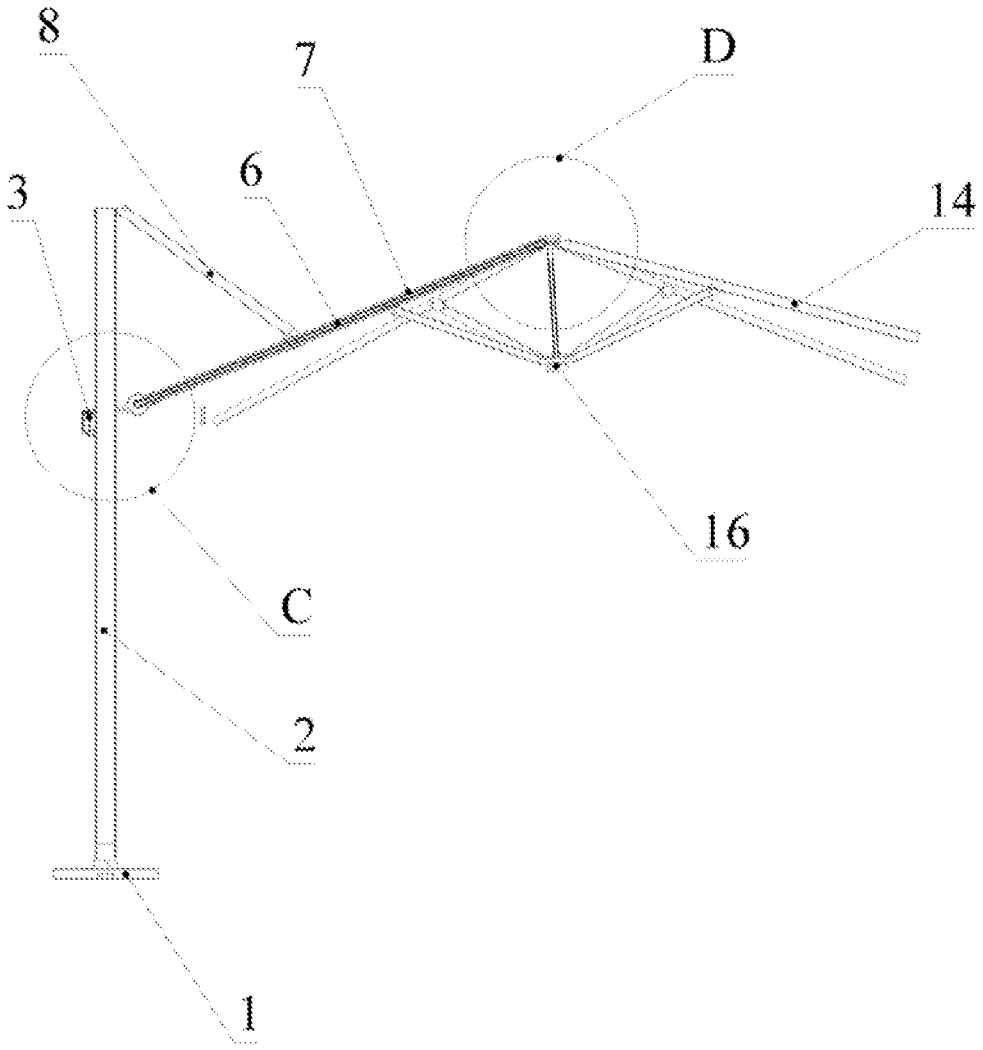
FIG. 7 is a sectional view of a novel side-arm umbrella structure of the present invention.
Figure 8:
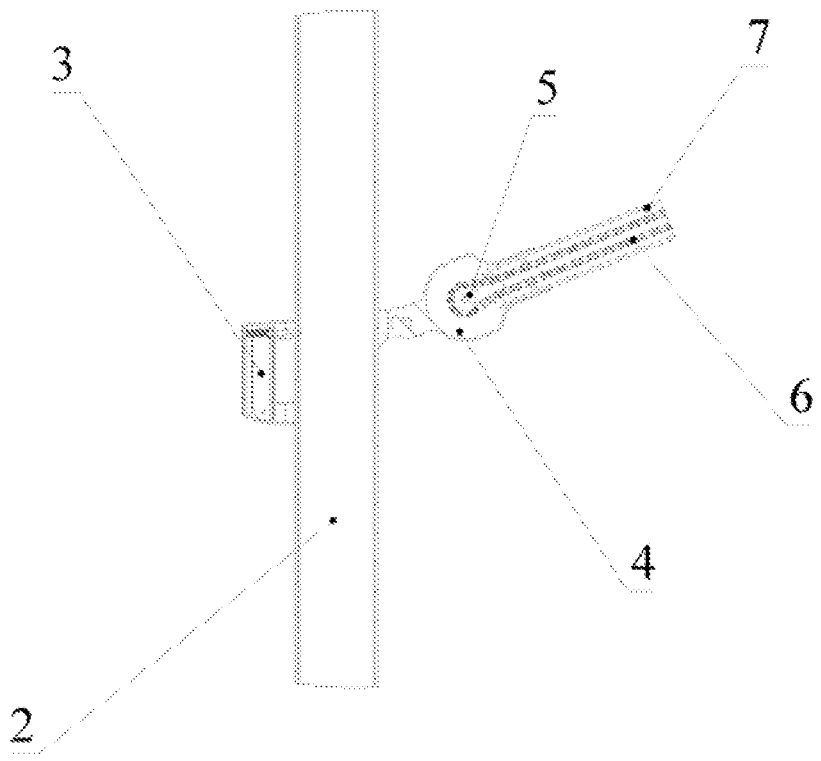
FIG. 8 is an enlarged view at C in FIG. 7.
Figure 9:
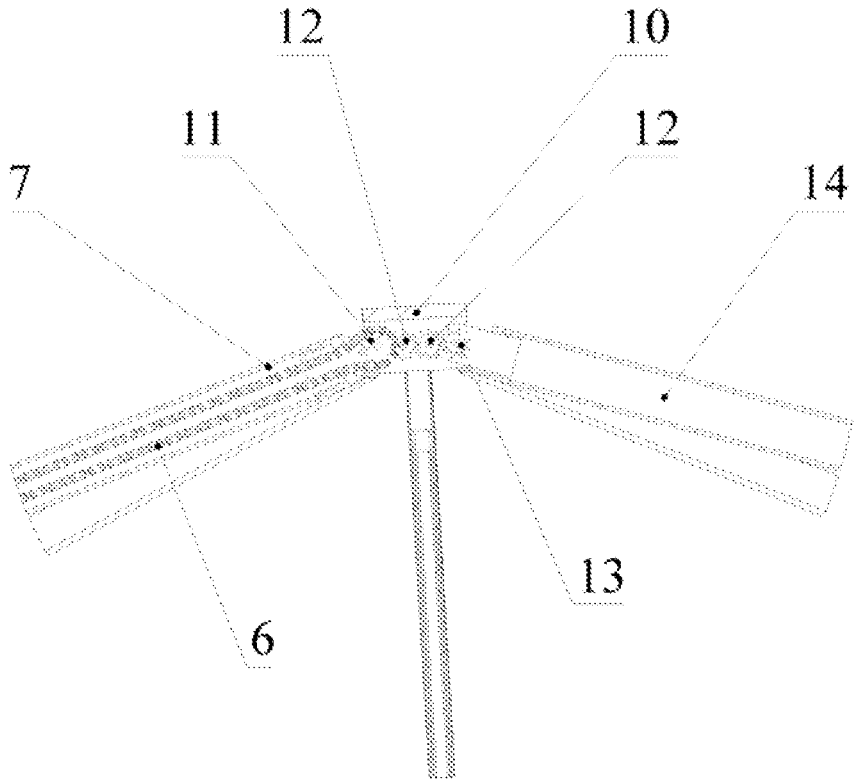
FIG. 9 is an enlarged view at D in FIG. 7.

Specifically, as shown in FIGS. 7 to 9, the driving mechanism includes a crank hand crank 4 and a power gear 5 driven by the crank hand crank 4. The power gear 5 and the driving gear 11 are in transmission connection through a chain 6, and both the chain 6 and the power gear 5 are built in the first diagonal pull rod 7.

In this embodiment, the user drives the power gear 5 to rotate by turning the crank hand crank 4, and then drives the driving gear 11 to rotate by using the chain 6. The chain transmission mode can maintain the accurate average transmission ratio, and has high transmission efficiency and strong overload capacity, and at the same time, the structure is simple and reliable, which can greatly prolong the service life of the side-arm umbrella.

In some embodiments, for the convenience of users, a motor-driven mode can also be adopted, for example, a motor is used to drive the power gear 5 to rotate instead of the crank hand crank 4, thus saving the physical strength of users and facilitating their operation. In some embodiments, the motor can also take the form of remote control, and the folding of the side-arm umbrella can be remotely controlled by configuring the user end.

According to the present invention, by connecting each umbrella rib with the upper hinge disc, the potential safety hazard of pulling wire breakage in the prior art is avoided, and the safety of users is greatly guaranteed.

In another embodiment of the present invention, the hand crank 4 is also provided with a locking mechanism (not shown in the figure), which can limit the rotation of the hand crank 4, thus limiting the transmission of the chain, and finally fixing the unfolding and storing state of the side-arm umbrella. In some embodiments, the locking mechanism can adopt bolt locking mode or other locking modes, as long as it can limit the transmission of the chain.

As a preferred embodiment of the present invention, the umbrella body of the present invention can have different unfolding and folding angles relative to the bracket 2.

Specifically, as shown in FIG. 7, the lower end of the first diagonal pull rod 7 is hinged with the slider 3, which is slidably arranged on the bracket 2. The slider 3 is provided with a locking mechanism (not shown in the figure) which can fix the slider 3 on the bracket 2. The middle part of the first diagonal pull rod 7 is connected with the upper end of the bracket 2 by a hinge rod 8, and both ends of the hinge rod 8 are rotatable.

In this embodiment, the umbrella body uses the slider 3 to move up and down on the bracket 2 to realize a variety of deployment and storage angles, and the user can adjust the corresponding angles according to different use requirements. For example, on the beach, the user can adjust the corresponding deployment angle of the umbrella body according to the angle of solar irradiation to cope with ultraviolet irradiation.

In order to further facilitate users to use the side-arm umbrella, as shown in FIG. 1, the present invention also provides a base 1, and the side-arm umbrella can be stably placed on the ground by the weight of the base 1.

In some embodiments, the base 1 can be configured with a plurality of accommodating cavities to accommodate water or other heavy objects, so as to increase the weight of the base 1 and make the side-arm umbrella not easy to overturn. In other embodiments, the base 1 can also be configured with a mobile kit, so that the side-arm umbrella can be moved by using the base 1, which is convenient for users to use in different positions. In other embodiments, the base 1 can be directly fixed to the ground, making the side-arm umbrella more difficult to overturn. In some embodiments, the bracket 2 can be directly fixed on a wall or a wall without setting the base 1, and the bracket 2 will be configured as a connector for connecting the wall or the wall.

In specific use, in order to facilitate the understanding of the present invention, it is described with the attached drawings:

Overall angle adjustment of the umbrella body: the slider 3 can slide through the bracket 2 and is equipped with a locking mechanism. After the locking mechanism is unlocked, the overall movement of the umbrella body can be realized through the vertical sliding of the slider 3 on the bracket 2, which shows that the umbrella body switches back and forth between the horizontal state and the vertical state. After adjusting the angle between the umbrella body and the bracket 2, the locking mechanism is locked again, and the umbrella body can be fixed at the required angle.

Opening or closing the umbrella body: when the hand crank 4 is rotated, the driving gear 5 rotates to drive the driving gear 11 to rotate, and the driving gear 11 rotates the driven gear 13 through two intermediate gears 12, and the driven gear 13 and the second diagonal pull rod 14 are fixed (the driven gear 13 cannot freely rotate on the second diagonal pull rod 14), thus realizing the change of the included angle between the second diagonal pull rod 14 and the first diagonal pull rod 7. Meanwhile, the second diagonal pull rod 14 drives a plurality of ribs 9 to move synchronously through the fabric on the umbrella surface, and the upper hinge disc 10 and the lower hinge disc 16 can be designed to be close to or far away from each other by the upper umbrella post 17 and the lower umbrella post 18, that is, the umbrella body is unfolded or folded as a whole.

The technical means disclosed in the solution of the present invention are not limited to the technical means disclosed in the above embodiments, but also include the technical solution composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. A novel side-arm umbrella structure, consisting of a bracket and an umbrella body connected to one side of the bracket, wherein the umbrella body is composed of an upper hinge disc, a lower hinge disc, a first diagonal pull rod, a second diagonal pull rod, a plurality of umbrella ribs and a plurality of n-umbrella braces, wherein a lower end of each umbrella brace of the plurality of umbrella braces is hinged on the lower hinge disc, and an upper end of each umbrella brace of the plurality of umbrella braces is hinged at a middle parts of each of a respective umbrella rib of the plurality of umbrella ribs, and the first diagonal pull rod and the second diagonal pull rod;

an upper end of each umbrella rib of the plurality of umbrella ribs is hinged on the upper hinge disc;

an upper end of the second diagonal pull rod is hinged on the upper hinge disc, and a driven gear is fixed on the upper end of the second diagonal pull rod;

an upper end of the first diagonal pull rod is hinged on the upper hinge disc, and the upper end of the first diagonal pull rod is provided with a rotatable driving gear;

the first diagonal pull rod is internally provided with a driving mechanism to drive the driving gear to rotate, and the upper hinge disc is internally provided with two intermediate gears to realize the transmission between the driving gear and the driven gear;

the umbrella body is hinged with the bracket by the first diagonal pull rod.

2. The novel side-arm umbrella structure according to claim 1, wherein an upper umbrella post is hinged below the upper hinge disc, and a lower umbrella post is hinged above the lower hinge disc.

3. The novel side-arm umbrella structure according to claim 2, wherein the upper umbrella post is provided with a central hole, and the lower umbrella post is inserted into the central hole of the upper umbrella post in a matching manner.

4. The novel side-arm umbrella structure according to claim 1, wherein a slider is hinged at a lower end of the first diagonal pull rod, and the slider is slidably arranged on the bracket.

5. The novel side-arm umbrella structure according to claim 4, wherein the slider is provided with a locking mechanism which can fix the slider on the bracket.

6. The novel side-arm umbrella structure according to claim 1, wherein the middle part of the first diagonal pull rod is connected with an upper end of the bracket by a hinge rod.

7. The novel side-arm umbrella structure according to claim 6, wherein both ends of the hinge rod are rotatable structures.

8. The novel side-arm umbrella structure according to claim 1, wherein the driving mechanism comprises a hand crank and a power gear driven by the hand crank, and the power gear and the driving gear are in transmission connection by a chain; the chain and the power gear are both built in the first diagonal pull rod.

9. The novel side-arm umbrella structure according to claim 1, wherein a bottom of the bracket is fixedly connected with a base, and the side-arm umbrella is stably placed on the ground by the weight of the base.

* * * * *